United States Patent [19]

Regalbuto

[11] Patent Number: 4,681,037

[45] Date of Patent: Jul. 21, 1987

[54] TANGED CHARGE HOLDER

[75] Inventor: John A. Regalbuto, Fort Worth, Tex.

[73] Assignee: Jet Research Center, Inc., Arlington, Tex.

[21] Appl. No.: 816,172

[22] Filed: Jan. 3, 1986

[51] Int. Cl.[4] ..... F42B 1/02

[52] U.S. Cl. ..... 102/310; 102/312; 102/313; 102/321; 102/331; 175/4.6

[58] Field of Search ..... 102/306-310, 102/312, 313, 331, 321; 175/4.6; 297/13

[56] References Cited

U.S. PATENT DOCUMENTS

| | | | |
|---|---|---|---|
| 2,756,677 | 7/1956 | McCullough | 102/20 |
| 2,760,434 | 8/1956 | Ruth | 102/20 |
| 2,986,089 | 5/1961 | Meddick | 102/20 |
| 3,078,797 | 2/1963 | Blair | 102/20 |
| 4,312,273 | 1/1982 | Camp | 102/310 |
| 4,598,775 | 7/1986 | Vann et al. | 102/310 X |
| 4,609,057 | 9/1986 | Walker et al. | 102/310 X |

OTHER PUBLICATIONS

U. S. patent application Ser. No. 651,201, filed Sep. 17, 1984, entitled Shaped Charge Carrier Assembly (only the structure shown in FIGS. 1-7 and 13 is part of the prior art).

*Primary Examiner*—Peter A. Nelson

*Attorney, Agent, or Firm*—Joseph A. Walkowski; Lucian Wayne Beavers

[57] ABSTRACT

A shaped charge carrier assembly includes a strip type carrier having openings therein for receiving shaped charges. Each of the openings includes first and second diagonally opposed pairs of resilient tabs for snugly engaging an outer case of the shaped charge. In a preferred embodiment, every second one of the openings includes first and second elongated cord receiving slots communicated therewith, so that the assembly can be put together without threading a free end of a firing cord through openings in the carrier. Integral intermediate portions of the firing cord can be placed through the alternate openings in the elongated cord receiving slots associated therewith without threading the free ends of the firing cord therethrough.

14 Claims, 3 Drawing Figures

TANGED CHARGE HOLDER

BACKGROUND OF THE INVENTION

1. Field of the Invention

The invention relates to a shaped charge carrier assembly of the type utilized to perforate an oil or gas well. The invention particularly pertains to the manner in which the shaped charge is held in place relative to the carrier, and to the manner in which the detonating cord is assembled with the carrier and the shaped charges.

2. Description of the Prior Art

Perforating guns commonly used in wire line service operations for perforating an oil or gas well typically include a carrier having a plurality of shaped charges attached thereto with a detonating cord assembled with the carrier and engaged with the shaped charges for detonating them. This assembly may be housed in a hollow cylindrical housing, or in some cases, the carrier assembly itself is lowered into the well without a protective housing. If a protective housing is not utilized, a dome-shaped cover may be placed over the forward face of the shaped charge to assure that an appropriate minimum standoff distance is maintained between the charge and the wellbore.

Recently, the assignee of the present invention has developed an improved shaped charge carrier made of sheet metal which has openings formed therein along with resilient tab means adjacent those openings. The shaped charges may be assembled with the carrier by merely pressing them into the openings. The resilient tab means forcibly grip the shaped charges and hold them in place within the carrier.

This prior art device is shown and described in detail in U.S. patent application Ser. No. 651,201 filed Sept. 17, 1984, for SHAPED CHARGE CARRIER ASSEMBLY, which is assigned to the assignee of the present invention. The structure shown in FIGS. 1–7 and 13 of Application Ser. No. 651,201 is a part of the prior art. That device utilizes two diagonally opposed resilient tabs which engage a threaded outer surface of the charge for holding each shaped charge in place. It is noted that Application Ser. No. 651,201 itself is not a part of the prior art. Applicants are merely referring to FIGS. 1–7 and 13 of that prior application as a convenient means of describing the structure shown in those figures, which structure is a part of the prior art. Any disclosure of Application Ser. No. 651,201 which is not illustrated in FIGS. 1–7 and 13 is not conceded to be a part of the prior art.

Additionally, the prior art has included a number of flat strip type carriers having shaped charges placed through openings in the carriers and having a detonating cord threaded through openings of the carriers for engagement with each of the shaped charges. Such devices are shown for example in U.S. Pat. No. 4,312,273 to Camp; U.S. Pat. No. 3,078,797 to Blair; U.S. Pat. No. 2,760,434 to Ruth; and U.S. Pat. No. 2,756,677 to McCullough.

Although the recently developed flexible tab type holding means disclosed in Application Ser. No. 651,201 has provided a significant improvement in shaped charge carrier assemblies, the present invention provides an improved version of that flexible tab type holding means. Further, the improved flexible tab type holding means of the present invention is particularly adapted for use in a flat strip type carrier assembly and provides a uniquely efficient manner of assembling the strip type carrier, the shaped charges and the detonating cord.

SUMMARY OF THE INVENTION

A shaped charge carrier assembly apparatus is provided, and includes a carrier and a plurality of shaped charges. Each of the shaped charges includes an outer case having an outer surface and a first shoulder extending radially outward from the outer surface.

The carrier has an opening therethrough for receiving the outer surface of the case of each of the shaped charges. The carrier includes at least first pair of resilient tab means extending into the opening for frictionally engaging the outer surface of the case and for holding the shaped charge in place relative to the carrier with the shoulder of the shaped charge abutting the carrier. This pair of resilient tab means includes first and second resilient tabs defined by a first three spaced slots. The three slots each have an open end communicating with the opening of the carrier, and a middle one of the three slots is located between and defines adjacent sides of the first and second tabs of the first pair of resilient tab means.

Preferably, the carrier includes two diametrically opposed pairs of resilient tab means associated with each of the charge receiving openings.

In a preferred form of the invention, alternate ones of the charge receiving openings have the middle slots of the three slots asociated with each pair of resilient tabs constructed as elongated cord receiving slots extending in substantially opposite directions from the charge receiving opening.

This permits a detonating cord to be assembled with the carrier and the shaped charge by inserting an integral intermediate portion of the detonating cord in a first direction through one of the openings having the elongated cord receiving slots associated therewith without passing a free end of the detonating cord through the opening or its associated cord receiving slots. This permits the elongated carrier, the plurality of shaped charges, and the detonating cord to be assembled without threading the free end of the detonating cord through openings in the carrier.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 2 is set forth in the drawings as a projection of the carrier strip of FIG. 1, so that the various charge receiving openings seen in FIG. 2 correspond to the charges seen in FIG. 1.

DETAILED DESCRIPTION OF THE PREFERRED EMBODIMENT

Figure 1:
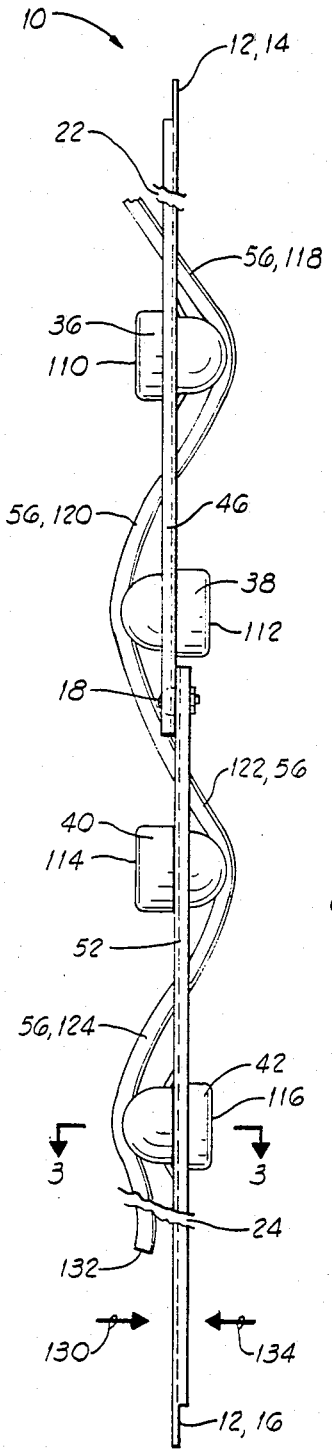
FIG. 1 is a left side elevation view of the shaped charge carrier assembly apparatus of the present invention.

Referring now to the drawings, and particularly to FIG. 1, the shaped charge carrier assembly apparatus of the present invention is shown and generally designated by the numeral 10.

The apparatus 10 includes a thin wall strip type carrier 12 made up of upper and lower sections 14 and 16 connected together by a bolt 18 and nut 20.

In a typical embodiment of the apparatus 10, the carrier 12 would have an overall length of approximately twenty feet with each of the sections 14 and 16 having a length of approximately ten feet.

As indicated by break lines 22 and 24, only a representative segment of each of the upper and lower sections 14 and 16 of carrier 12 are illustrated.

Figure 2:
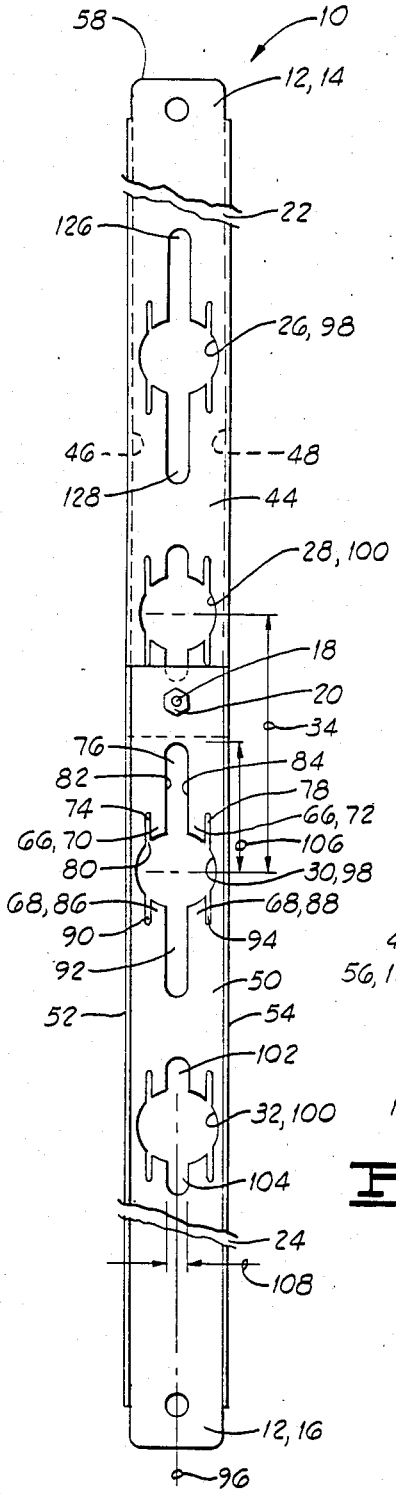
FIG. 2 is a front elevation view of the elongated carrier strip of the assembly of FIG. 1.

The carrier 12 has a plurality of charge receiving openings disposed therethrough, a representative sample of which has been illustrated in FIG. 2 and designated by the numerals 26, 28, 30 and 32.

In a typical embodiment of the apparatus 10, a vertical spacing 34 of three inches is provided between adjacent openings such as 28 and 30. The openings are substantially equally spaced along the length of carrier 12.

As seen in FIG. 1, a shaped charge is received in each of the openings, and the four charges seen in FIG. 1 are designated by the numerals 36, 38, 40 and 42.

The upper section 14 of carrier 12 includes a flat middle strip portion 44 with narrower flanges such as 46 and 48 extending from one side thereof.

Similarly, the lower section 16 includes a middle strip portion 50 having flanges 52 and 54 extending from one side thereof.

In connecting the upper and lower sections 14 and 16 with the nut and bolt 18 and 20, the flanges of the strip section 14 and 16 are faced away from each other so that the flat back sides of the middle strip portions 44 and 50 are engaged as seen in FIG. 1.

As seen in FIG. 1, a detonating cord 56 is assembled with the carrier 12 and the shaped charges 36, 38, 40 and 42.

Although not illustrated in the drawings, the upper end 58 of carrier 12 will be suspended from a wire line, or if the carrier 12 is located within a perforating gun housing, that housing will be suspended from a wire line. Associated with the wire line will be a firing head means (not shown), which is typically actuated by an electrical signal sent down the wire line. The detonating cord 56 is operably associated with the firing head means so that the shaped charges 36, 38, 40 and 42 will be fired in response to an electrical signal directed down the wire line in a manner well known to those skilled in the art.

Figure 3:
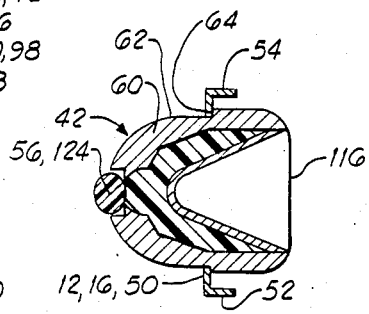
FIG. 3 is a section horizontal view, taken along line 3—3 of FIG. 1, showing the manner in which one of the shaped charges is received within the carrier and has the detonating cord assembled therewith.

As seen in FIG. 3, each of the shaped charges such as 42 includes an outer case 60 having a smooth cylindrical outer surface 62 and having a shulder 64 extending radially outward from surface 62.

Each of the openings such as 26, 28, 30 and 32 of carrier 12 is generally circular in shape and is large enough to receive the cylindrical outer surface 62 of case 60 of charges such as 36, 38, 40 and 42 therethrough.

The details of the openings will not be described with reference to opening 30. The carrier 12 includes first and second diametrically opposed pairs of resilient tab means 66 and 68 extending into the opening 30 for frictionally engaging the outer surface 62 of case 60 and for thereby holding the shaped charge 40 in place relative to the carrier 12 with the shoulder 64 of shaped charge 40 abutting the middle strip portion 50 of lower section 16 of carrier 12.

The first and second pairs of resilient tab means 66 and 68 can generally be described as charge retaining means for retaining the shaped charge 40 in place within the charge receiving opening 30 of the carrier 12.

The first pair of resilient tab means 66 includes first and second resilient tabs 70 and 72 defined by a first three spaced slots 74, 76 and 78.

Each of the slots 74, 76 and 78 includes an open end such as open end 80 of slot 74, communicating with the opening 30 of the carrier 12.

The middle one 76 of the first three slots 74, 76 and 78, is located between and defines adjacent sides 82 and 84 of first and second tabs 70 and 72, respectively.

Similarly, the second pair of resilient tab means 68 includes third and fourth resilient tabs 86 and 88, respectively, defined by a second three spaced slots 90, 92 and 94.

Each of the tabs such as 70, 72, 86 and 88 is oriented substantially parallel to a longitudinal axis 96 of carrier 12.

The first three spaced slots 74, 76 and 78 defining the first pair of resilient tab means 66 are aligned with and substantially parallel to the second set of three spaced slots 90, 92 and 94, respectively, definining the second pair of resilient tab means 68.

The middle ones 76 and 92 of each set of three slots defining one of the pairs of resilient tab means 66 or 68 are diametrically opposed to each other about opening 30 and are oriented substantially parallel to the longitudinal axis 96 of carrier 12. Additionally, the middle ones 76 and 92 of each set of three slots are substantially wider than the other two slots of that set.

The middle slots 76 and 92 associated with the opening 30 are further defined as elongated detonating cord receiving slots.

Referring now to FIG. 2, it is noted that the openings 26, 28, 30 and 32 disposed in carrier 12 are substantially aligned with each other in a row substantially parallel to the longitudinal axis 96 of carrier 12.

Alternate ones, such as 26 and 30, of the openings in carrier 12 have first and second elongated cord receiving slots, such as 76 and 92 associated with opening 30, communicated therewith and extending therefrom in substantially opposite directions. Opening 26 has elongated cord receiving slots 126 and 128 associated therewith.

Openings 26 and 30 can be said to be a part of a first set 98 of openings. The remaining openings such as 28 and 32 can be said to be part of a second set of openings 100. The openings are arranged so that an opening such as 30 of the first set 98 is located between two openings such as 28 and 32 of the second set 100.

The two sets of openings 98 and 100 are distinguished from each other in that the openings such as 26 and 30 of the first set 98 have the elongated cord receiving slots such as 76 and 92 associated therewith.

It is readily apparent in FIG. 2 that the openings such as 28 and 32 of the second set 100 have middle slots, such as 102 and 104 which are associated with opening 32, which are substantially longitudinally shorter than the elongated cord receiving middle slots 76 and 92 associated with openings such as 30 of the first set 98.

Each of the elongated cord receiving slots such as slot 76 extends from the center of its associated opening through a distance as indicated by 106 to a location at least substantially half the distance 34 to the next adjacent opening 28. Also slot 76 terminates short of the adjacent opening 28.

Both the longer middle slots such as 76 and 92 and the shorter middle slots such as 102 and 104 have substantially equal widths 108. Additionally, the outer slots of each group of three slots are substantially identical so that the tabs associated with the first set of openings 98 having the long middle slots have substantially equal resiliency as the tabs associated with the second set 100 of openings having the shorter middle slots. The purpose of this is to provide a substantially identical tab structure at each of the openings so that the charges are identically received in and held within any one of the openings regardless of whether it has long middle slots or short middle slots.

As is explained in detail in pending Application Ser. No. 651,201 discussed above, each of the tabs such as 70, 72, 86 and 88 extend slightly into their associated opening and are resiliently deflected rearwardly when a charge is inserted into the opening.

By providing two pairs of tabs, as compared to two single tabs used in the device of Application Ser. No. 651,201, the present invention provides four supporting tabs surrounding the case of the shaped charge, instead of two, which tends to provide better alignment of the charge relative to the planar middle surface 44,50 of the strip type carrier 12. This is an important improvement, because as will be understood by those skilled in the art, the directional orientation of the shaped charges is important and it is preferred that the charge be directed substantially normal to the surface of the wellbore which it is to perforate.

Also, be providing four resilient tabs instead of just two, the increased friction has permitted the threaded type outer surface on the case of the charges in Ser. No. 651,201 to be eliminated.

As is apparent in FIG. 1, successive ones of the shaped charges such as 36 and 38, face in substantially opposite directions. That is, in FIG. 1, a front end 110 of shaped charge 36 faces to the left, whereas a front end 112 of shaped charge 38 faces to the right. Similarly, a front end 114 of shaped charge 40 faces to the left and front end 116 of shaped charge 42 faces to the right.

As is also apparent in viewing FIGS. 1 and 2, the detonating cord 56 is received through the elongated cord receiving middle slots such as 76 and 92 associated with openings such as 30 of the first set 98, and the detonating cord 56 does not pass through the openings such as 28 and 32 of the second set 100 or through the shorter middle slots associated with those openings.

Generally, the arrangement of the detonating cord 56 can be described as having successive integral portions such as 118, 120, 122 and 124 located on opposite sides of the carrier 12. That is, adjacent ones, such as 118 and 120, of these integral portions are located on opposite sides of the strip carrier 12.

Further, it is apparent in FIGS. 1 and 2 that the detonating cord 56 extends once and only once through each of the elongated cord receiving slots such as slots 76 and 92 associated with opening 30 and similarly through elongated cord receiving slots 126 and 128 associated with opening 26.

As is apparent in FIGS. 1 and 3, the shoulder 64 of case 60 of shaped charge 42 abuts the middle strip portion 50 of lower section 16 of carrier 12 on a side of carrier 12 opposite from the integral portion 124 of detonating cord 56 which is engaged with the rear end of the case 60 of shaped charge 42.

SUMMARY OF METHOD OF ASSEMBLY

To assemble the apparatus 10, an elongated carrier such as the carrier 12 is provided having the plurality of openings such 26, 28, 30 and 32 disposed therethrough. At least every second one of these openings must have the first and second elongated cord receiving slots such as 76 and 92 communicated therewith and extending therefrom in substantially opposite directions.

Referring to FIG. 1, the detonating cord 56 could be placed along the left-hand side of the carrier 12.

Then, an integral intermediate portion such as intermediate portion 122 of detonating cord 56 is inserted in a first direction, which is indicated by the arrow 130 in FIG. 1, through the opening 30 and the first and second cord receiving slots 76 and 92 associated therewith without passing a free end, such as lower end 132, of detonating cord 56 through the opening 30 or its associated cord receiving slots 76 and 92.

After the intermediate portion 122 of firing cord 56 has been inserted through the opening 30, the shaped charge 40 is inserted through the opening 30.

The detonating cord 56 is engaged with the shaped charges in the manner shown in FIG. 3 for shaped charge 42.

It should be noted that the detonating cord 56 can be engaged with the shaped charge 40 prior to the time the detonating cord 56 is inserted through the opening 30. Then, the detonating cord 56 and shaped charge 40 could be inserted into the opening 30 in a single motion, but the detonating cord 56 would still pass through the opening 30 before the shaped charge 40 would pass through the opening 30.

The detonating cord 56 can be attached to the shaped charge 40 either before or after the shaped charge 40 has been inserted within the opening 30.

In the embodiment shown in the drawings, it is noted that the shaped charge 40 is inserted through the opening 30 in the same first direction 130 in which the firing cord 56 was inserted through the opening 30.

The front end 114 of the shaped charge 40 faces in a second direction, indicated by the arrow 134 which is opposite the direction in which the shaped charge 40 and the firing cord 56 were inserted through the opening 30.

As previously noted, the detonating cord 56 does not pass through the openings such as 28 and 32 of the second set 100 or through the shorter middle slots such as 102 and 104 associated therewith.

The shaped charges such as 38 and 42 are inserted into the openings 28 and 32 of the second set 100 in the second direction 134.

After the shaped charges such as 38 and 42 are in place within the openings 28 and 32 of the second set 100, the detonating cord 56 is engaged with the rear end of those shaped charges 38 and 42.

Thus, the apparatus 10 can be assembled without threading the free ends such as 132 of firing cord 56 through openings in the carrier 12.

Instead, it is only necessary to insert integral intermediate portions such as 118 and 122 of the firing cord 56 through openings such as 26 and 30 of the first set 98.

This significiantly reduces the required time for assembly of a strip type carrier as compared to prior art designs such as those seen in U.S. Pat. Nos. 4,312,273 to Camp, 3,078,797 to Blair, 2,760,434 to Ruth, and 2,756,677 to McCullough.

Thus it is seen that the apparatus and methods of the present invention readily achieve the ends and advantages mentioned as well as those inherent therein. While certain preferred embodiments of the invention have been illustrated for the purposes of the present disclosure, numerous changes in the arrangement and construction of parts and steps may be made by those skilled in the art, which changes are encompassed within the scope and spirit of the present invention as defined by the appended claims.

What is claimed is:

1. A shaped charge carrier assembly apparatus, comprising:

at least one shaped charge including an outer case having an outer surface and a first shoulder extending radially outward from said outer surface; and a carrier having at least one opening therethrough large enough to receive said outer surface of said case, and having at least a first pair of resilient tab means extending into said opening for frictionally engaging said outer surface of said case and for thereby holding said shaped charge in place relative to said carrier with said shoulder of said shaped charge abutting said carrier, said pair of resilient tab means including first and second resilient tabs defined by a first three spaced slots, said slots each having an open end communicating with said opening of said carrier, and a middle one of said slots being located between and defining adjacent sides of said first and second tabs.

2. The apparatus of claim 1, wherein:

said carrier includes a second pair of resilient tab means extending into said opening for frictionally engaging said outer surface of said case, said second pair of resilient tab means being diametrically opposed about said opening to said first pair of resilient tab means.

3. The apparatus of claim 2, wherein:

the tabs of said first and second pairs of resilient tab means are oriented substantially parallel to a longitudinal axis of said carrier.

4. The apparatus of claim 3, wherein:

said three spaced slots defining said first and second tabs of said first pair of resilient tabs means are aligned with and substantially parallel to three spaced slots defining said second pair of resilient tab means.

5. The apparatus of claim 2, wherein:

said middle one of said three spaced slots is substantially wider than the other two of said three spaced slots.

6. The aparatus of claim 2, wherein:

said middle one of said three spaced slots defining said first pair of resilient tab means, and a middle one of three spaced slots defining opposed about said opening and are oriented substantially parallel to a longitudinal axis of said carrier.

7. The apparatus of claim 2, wherein:

said outer surface of said case engaged by said first and second pairs of resilient tab means is a substantially smooth outer cylindrical surface.

8. The apparatus of claim 2, wherein:

said second pair of resilient tab means includes third and fourth resilient tabs defined by a second three spaced slots, a middle slot of which is located between and defines adjacent sides of said third and fourth tabs; and said middle slots of said first three spaced slots and said second three spaced slots are first and second elongated cord receiving slots communicated with said at least one opening and extending therefrom in substantially opposite directions.

9. The apparatus of claim 8, wherein:

said carrier includes a plurality of charge receiving openings, alternate ones of said openings each having first and second cord receiving slots associated therewith;

said assembly includes a plurality of said shaped charges, one of which is received in each of said charge receiving openings, successive ones of said charges facing in substantially opposite directions; and said apparatus further includes a detonating cord having successive integral portions thereof located on opposite sides of said carrier, each of said integral portions operably engaging one of said shaped charges, and said cord extending once and only once through each of said first and second elongated cord receiving slots associated with each of said alternate ones of said openings.

10. A shaped charge carrier assembly apparatus, comprising:

an elongated thin wall strip carrier having a plurality of charge receiving openings disposed therethrough, said openings being substantially equally spaced along said elongated carrier and substantially aligned with each other substantially parallel to a longitudinal axis of said elongated carrier, alternate ones of said openings having first and second elongated cord receiving slots communicated therewith and extending therefrom in substantially opposite directions, each of said elongated cord receiving slots extending to a location at least substantially half a distance to an adjacent one of said openings and terminating short of said adjacent one of said openings;

a plurality of shaped charges, one of which is received in each of said charge receiving openings of said carrier, successive ones of said charges facing in substantially opposite directions;

a plurality of charge retaining means for retaining said charges in place within said charge receiving openings of said carrier; and a detonating cord having successive integral portions thereof located on opposite sides of said carrier, each of said integral portions operably engaging one of said shaped charges, and said cord extending once and only once through each of said first and second elongated cord receiving slots.

11. The apparatus of claim 10, wherein:

each of said openings is substantially circular;- each of said charge retaining means includes first and second substantially diametrically opposed pairs of resilient tab means extending into an associated one of said openings for frictionally engaging a substantially cylindrical outer surface of an outer case of one of said shaped charges;

each of said pairs of resilient tab means is defined by a group of three spaced slots, said slots each having an open end communicating with said associated opening, a middle one of said three slots being substantially wider than the other two; and said first and second elongated cord receiving slots of said alternate ones of said openings are said middle ones of three slots of said groups.

12. The apparatus of claim 11, wherein:

said plurality of openings includes a first set and a second set of openings arranged so that an opening of said first set is located between two openings of said second set, said alternate ones of said openings being said first set; and said middle ones of said three slots of each group of three slots associated with one of said openings of said second set of openings are substantially longitudinally-shorter than said elongated cord receiving slots associated with said first set of openings.

13. The apparatus of claim 12, wherein:

said middle ones of said three slots of each group of three slots associated with said first set of openings, and said shorter middle ones of said three slots of each group of three slots associated with said second set of openings, have substantially equal widths.

14. The apparatus of claim 11, wherein:

each of said shaped charges includes aid outer case having said substantially cylindrical outer surface and a first shoulder extending radially outward from said outer surface, said case being partially received through said associated one of said charge receiving openings with said shoulder abutting said carrier on a side of said carrier opposite from one of said successive integral portions of said cord engaged with said shaped charge.

* * * * *

UNITED STATES PATENT AND TRADEMARK OFFICE

CERTIFICATE OF CORRECTION

PATENT NO. : 4,681,037

DATED : July 21, 1987

INVENTOR(S) : John A. Regalbuto

It is certified that error appears in the above-identified patent and that said Letters Patent is hereby corrected as shown below:

In column 3, line 64, delete "not" and insert —now— therefor.

In column 5, line 35, delete "be" and insert —by— therefor.

In column 7, line 58, after defining insert —said second pair of resilient tab means, are diametrically— therefor.

Signed and Sealed this

Tenth Day of November, 1987

*Attest:*

*Attesting Officer*

DONALD J. QUIGG

*Commissioner of Patents and Trademarks*